United States Patent [19]

Bascom et al.

[11] 4,372,801

[45] Feb. 8, 1983

[54] FILL STRAND TRANSFER APPARATUS FOR MAKING NON WOVEN FABRICS

[75] Inventors: Hollis H. Bascom, Livermore; Stephen Matweyou, Oakland; Alan J. Andersen; John J. Greci, both of Livermore, all of Calif.

[73] Assignee: Orcon Corporation, Union City, Calif.

[21] Appl. No.: 275,494

[22] Filed: Jun. 19, 1981

Related U.S. Application Data

[62] Division of Ser. No. 103,621, Dec. 14, 1979, Pat. No. 4,295,905.

[51] Int. Cl.[3] ..... B32B 5/12

[52] U.S. Cl. ..... 156/434; 156/439; 156/440; 156/548

[58] Field of Search ..... 156/434, 439, 440, 548

[56] References Cited

U.S. PATENT DOCUMENTS

| | | | |
|---|---|---|---|
| 3,391,039 | 7/1968 | Bascom et al. | 156/174 |
| 3,496,053 | 2/1970 | Bascom et al. | 156/181 |
| 3,573,137 | 3/1971 | Bascom et al. | 156/171 |
| 3,573,151 | 3/1971 | Dawborn | 156/439 |
| 3,582,443 | 6/1971 | Bascom | 156/181 |
| 4,095,312 | 6/1978 | Haley | 156/439 |
| 4,172,748 | 10/1979 | Petzetakis | 156/439 |

*Primary Examiner*—James J. Bell

*Attorney, Agent, or Firm*—Donald C. Feix

[57] ABSTRACT

Non woven fabrics are made by a method and an apparatus in which a preformed, planar set of adhesive coated or impregnated fill strands having a fixed orientation, spacing and tension of the fill strands is laminated to warp strands in the nip of pressure rolls.

Adhesive lines are printed on a side of the warp strands opposite that engaged by the fill strands to prevent warp strands from hanging loosely from that side of the fabric.

4 Claims, 7 Drawing Figures

FILL STRAND TRANSFER APPARATUS FOR MAKING NON WOVEN FABRICS

This application is a division of parent application Ser. No. 103,621 filed Dec. 14, 1979 now U.S. Pat. No. 4,295,905 and entitled "Fill Strand Transfer Process For Making Non Woven Fabrics" and claims the benefit of the filing date of the parent application.

CROSS REFERENCE TO A RELATED PATENT

U.S. Pat. No. 3,573,137 issued Mar. 30, 1971 to Bascom et al and assigned to the same assignee as this application discloses a machine and method for preparing a planar set of fill strands of the kind which is transferred to the warp strands in accordance with the present invention.

BACKGROUND OF THE INVENTION

The present invention relates to methods and apparatus for transferring fill strands to warp strands to produce a non woven fabric.

The present invention relates particularly to methods and apparatus for transferring fill strands to warp strand materials which are difficult to handle.

There are many materials which have presented special problems when attempts have been made to assemble the materials into wide widths, that is, widths wide enough to permit economical use in a variety of manufacturing processes. The materials may be difficult to handle because of abrasion resistance, fly or guiding problems. For example, graphite tape in one inch to three inch width is difficult to handle. Highly abrasive yarns like steel tire cord, where rolling spacing devices are desirable, are also difficult to handle materials.

Prior methods of weaving such materials or holding them together with resins or adhesives but without filling yarns have often resulted in degradation of final product properties or have produced a web that is uneconomical to handle because it has low integrity.

SUMMARY OF THE INVENTION

It is a primary object of the present invention to make non woven fabrics with warp strands of such difficult to handle materials by methods and apparatus which overcome the problems of the prior art.

In accordance with the present invention a planar set of adhesive coated or impregnated fill strands is preformed for subsequent transfer to warp strands of the difficult to handle material.

The warp strands are guided into the nip of a set of pressure rolls by a spacing device which is located as close as possible to the nip. In a specific embodiment the pressure rolls are heated.

The planar set of adhesive coated fill strands is fed into the nip with the warp strands, and the pressure and/or heat of the pressure rolls transfer the fill strands to the warp strands by causing the adhesive on the fill strands to soften and to adhere to the warp strands.

U.S. Pat. No. 3,573,137 issued Mar. 30, 1979 to Bascom et al. and assigned to the same assignee as this application discloses methods and apparatus for preparing a set of fill strands having the desired adhesive coating and the precise orientation, spacing and tension of the fill strands.

In the present invention the fill strands are transferred to warp strands in the nip of the pressure rolls, (rather than being applied directly to warp strands by the methods and apparatus disclosed in the '137 patent) because the warp strand materials that the present invention are concerned with are too fragile, stiff, or abrasive or have friction which is too low or too high for economical and efficient use in the process disclosed in the '137 patent.

Because the warp strands in the fill transfer process of the present invention are disposed in a plane, rather than in a cylindrical shape as required in the process of the '137 patent, many of the problems of these difficult to handle warp strand materials are obviated. The guiding and handling of the warp strands are minimized, and devices (such as rolling guides) which are impossible to use in the cylindrical configuration can be readily used in the planar configuration.

Fabrics made of heavy low twist yarn bundles, such as twenty end fiberglass roving, can present problems of loose yarns on the side of the fabric opposite that engaged by the fill strands because the adhesive from the fill strands may not completely penetrate the heavy bundle of warp strands.

One embodiment of the present invention eliminates such loose yarns by printing adhesive lines on the side of the bundle of warp strands opposite the side engaged by the fill strands.

Methods and apparatus for making a nonwoven fabric and which incorporate the techniques and structure described above and which are effective to function as described above constitute specific objects of this invention.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

DESCRIPTION OF THE PREFERRED EMBODIMENTS

Figure 1:
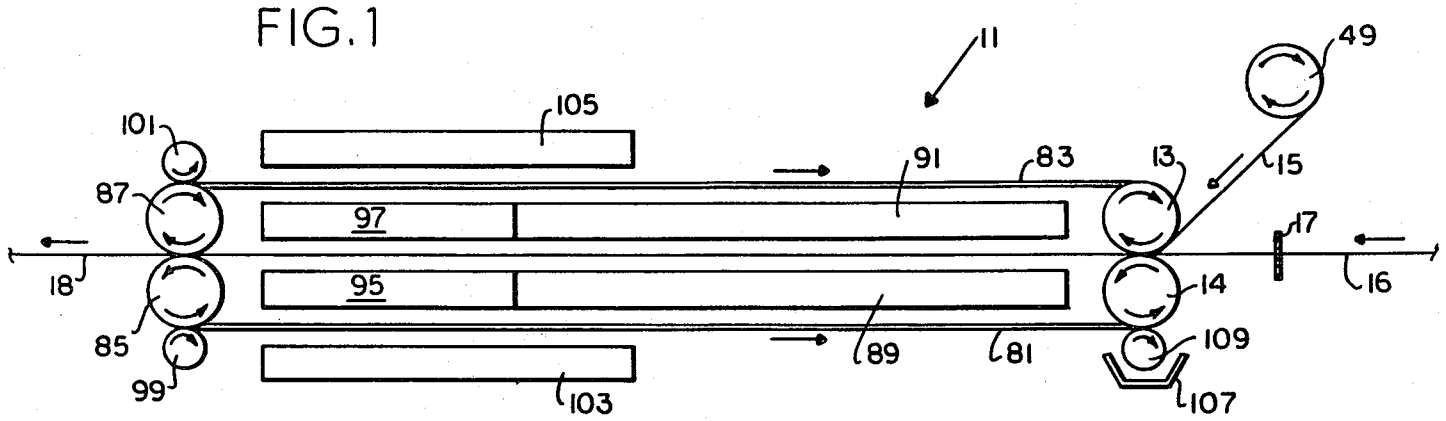
FIG. 1 is a side elevation view of apparatus for transferring fill strands to warp strands and constructed in accordance with one embodiment of the present invention.

A fill strand transfer apparatus for transferring fill strands to warp strands in accordance with one embodiment of the present invention is indicated generally by the reference numeral 11 in FIG. 1.

Figure 2:
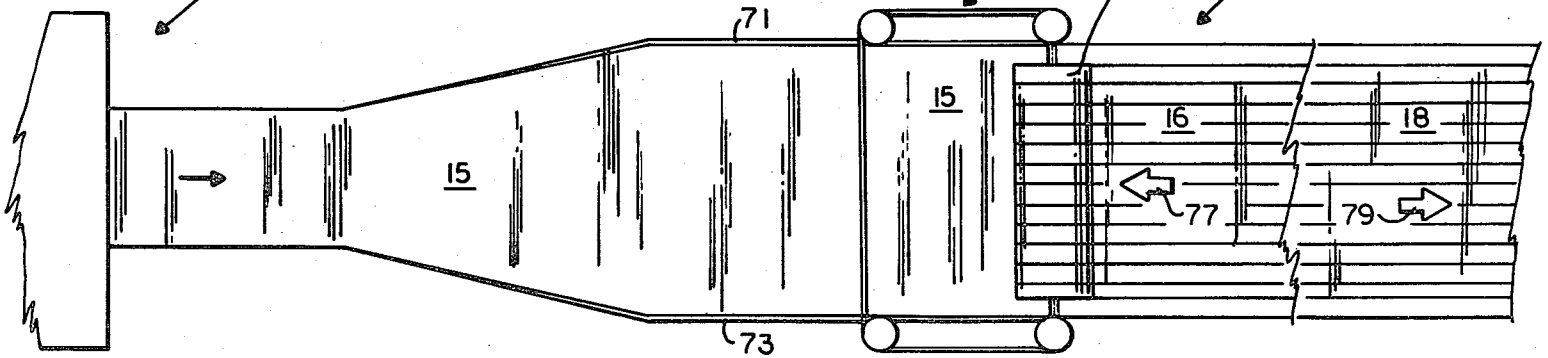
FIG. 2 is a plan view of apparatus for transferring fill strands to warp strands and constructed in accordance with another embodiment of the present invention.

FIG. 2 shows another embodiment, indicated generally by the reference numeral 12, of the present invention for transferring fill strands to warp strands.

Both of these embodiments will be described in more detail below, but for the moment it should be noted that each embodiment comprises pressure rolls 13 and 14. Only the upper roll 13 is visible in the plan view of FIG. 2.

In each embodiment a set of fill strands 15 is fed into the nip of the pressure rolls along with warp strands 16. In each embodiment the set of fill strands is pre-formed, rather than being made up at the time of being fed into the nip, and the fill strands have a precise and fixed orientation, spacing and tension. Each fill strand is impregnated or coated with an excess of adhesive of the kind which softens and flows under the pressure and/or heat of the pressure rolls. This causes the fill strands to be transferred to the warp strands 16 at the nip of the pressure rolls.

The warp strands 16 are guided into the nip by a spacing device, such as the reed 17 illustrated in FIG. 1, which is located as close to the nip of the pressure rolls as possible.

The excess adhesive on the fill strands, under the pressure and/or heat produced on the pressure rolls softens and adheres to the warp strands. The adhesive gains bond strength as it subsequently cools so that a nonwoven fabric 18 is formed by this fill transfer process.

Figure 3:
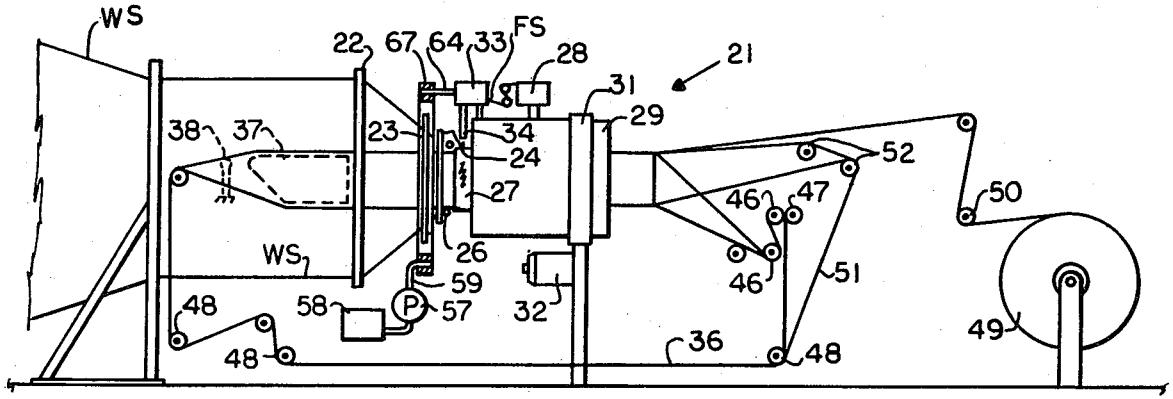
FIG. 3 is a side elevation view of a machine for producing a set of fill strands for use in the FIG. 1 and FIG. 2 embodiments.
Figure 5:
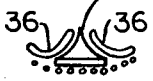
FIG. 5 is a fragmentary elevation view taken along the line and in a direction indicated by the arrows 5—5 in FIG. 4 and showing details of a separator mechanism for separating a fabric conveyor belt from the fabric at the time the fabric is cut and opened from the tubular configuration to a flat sheet.
Figure 4:
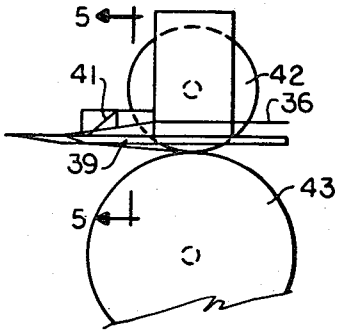
FIG. 4 is a fragmentary side elevation view of a cutter mechanism incorporated in the FIG. 3 machine for cutting the fill strands so that the fill strands can be opened from a tubular configuration to a flat sheet.

FIGS. 3–5 show the machine used for preparing the set of fill strands.

With the machine shown in FIGS. 3–5 the set of fill strands can be prepared in three ways. The fill strands can be prepared (1) as an open scrim fabric, (2) by direct attachment to a release sheet without any warp strands fed through the machine 21, or (3) by attachment to a narrow paper strip which is then split to form two edge tapes tensioned in a tenter frame as shown in FIG. 2. Each of these three methods of preparing sets of fill strands will be described in more detail below.

The machine 21 shown in FIGS. 3–4 is the same as that illustrated and described in U.S. Pat. No. 3,573,137 referred to above.

The machine 21 is of the general kind which is also disclosed in detail in U.S. Pat. Nos. 3,391,043 and 3,391,039, both assigned to the same assignee as the present invention. Reference is made to those patents and to the above noted U.S. Pat. No. 3,573,137 for details of the structure which are not described in detail below.

The machine 21 includes one or more creels and tension carts (not shown in FIG. 3) for imparting a measured tension to a plurality of warp strands WS (when warp strands are used for preparing the set of fill strands as an open scrim fabric as noted above).

The warp strands WS are not used when the set of fill strands is prepared by direct attachment to a release belt or by connection to the paper tapes as noted above.

When the warp strands WS are used, the warp strands are led through guide means comprising an eye board 22 and one or more reed guides 23 and 24. The warp strands WS are then led through a constricting ring 26 to the outer surface of a cylindrical support or mandrel 27.

One or more fill strand packages 28 are mounted on a drum 29. The drum 29 is mounted for rotation within a support 31 and is rotated by a motor 32. The fill strands FS are led from the packages into a magazine 33 which contains a liquid adhesive. The fill strand is trained through the adhesive and then through a metering and positioning tip 34 located close to the support 27. Because the warp strands (when used) and the transport belt 36 are continuously moving along the support, the fill strand traces a helical path as it successively engages the warp strands or transport belt 36 during rotation of the drum 29.

The transport belt 36 is converted from a flat belt to a tube shape by a former 37 located in front of the support 27. A roller 38 positioned in front of the former 37 provides effective support for the top part of the tube at the critical point in the formation of the tube.

Since the set of fill strands is formed in a tubular form, the fill strands have to be cut and opened to a flat configuration. FIG. 4 shows a cutter disc 42 rotated by a hardened roll 43 which engages the periphery of the disc and insures that the fill strands passing between the roll 43 and the disc 42 are cleanly cut.

It is important that the edges of the transport belt 36 be separated to some extent at the time that the fabric is cut to avoid trimming portions off the belt.

FIG. 5 shows a plow 41 which forces the side edges of the belt 31 up just prior to the time that the cutter disc 42 cuts the fill strands.

The transport belt 36 is pulled along the support 27 by one or more drive rolls 46. A pressure roll 47 maintains the belt 36 in driving contact with the drive roll 46. The belt 36 is an endless belt and returns to the inlet end of the support 27 by passing over a series of positioning rollers 48.

The set of fill strands after being cut by the cutter disc 42 is open to a flat sheet.

In a preferred embodiment of the invention the transport belt and fill strands are conducted at a downward angle (not illustrated in FIG. 3) as the transport belt and fill strands are opened to a flat sheet. This shortens the distance that is needed for opening the transport belt and fill strands from a tubular form to a flat sheet without imposing stresses.

In the case in which the set of fill strands is prepared as an open scrim fabric, the scrim is wound upon a storage roll 49. The storage roll 49 is driven by a separate motor, not shown, and the rotation of the storage roll 49 is coordinated with the speed of the transport belt 36 to prevent excessive droop of the scrim while avoiding stressing of the scrim. This coordination is provided by a dancer roll 50.

The transport belt 36 may be coated with a release film which resists sticking of the adhesive and thus facilitates the separation of the belt from the scrim.

Alternately, and as illustrated in FIG. 1, a separate release film 51 may be employed. In this case the release film 51 is carried along with the fill strands for some distance after the point at which the belt 36 is separated from the fill strands and the release film 51.

The release film 51, in one embodiment of the present invention, is then fed directly into the nip of the pressure rolls 13 and 14. In this embodiment, the fill strands are transferred to the warp strands 16 because the heat and pressure of the pressure rolls cause the adhesive on the fill strands to adhere to the warp strands; and after the bond to the warp strands has been cooled to add strength, the release film is pulled away from the bonded together fill strands and warp strands.

In this embodiment of the invention, the release film 51 is then returned to the transport belt 36 by passing the release film 51 over a series of rollers, such as the rollers 52 illustrated in FIG. 3.

In another embodiment of the present invention the release film 51, rather than being returned to the transport belt 36, is coated with a second release coating on the side opposite that carrying the set of warp strands. This second coating provides a higher degree of release than the release coating on the side of the film engaged with the fill strands so that the film and fill strands can be wound on a roll like the roll 49 and then unwound from the roll 49 without disturbing the position of the fill strands (since the second release coating permits that surface of the release film to release cleanly from the fill strands). The set of fill strands and the release film 51 are then fed from the roll 49 into the nip of the pressure rolls 13 and 14, and the release film 51 is later separated from the bonded together fill strands and warp strands by means of the release provided by the release coating on the side of the release film engaged with the fill strands.

In the embodiment shown in FIG. 2 neither warp strands WS nor the release film 51 is used. Instead, a narrow width strip of paper is fed into the machine 21 to overlap the edges of the transport belt 36. The fill strands FS bond to the strip of paper.

The strip of paper is cut by the disc 42 and split to form two paper tapes 71 and 73 (as illustrated in FIG. 2) which extend along the outer ends of the set of fill strands 15 when the fill strands are open from the tubular shape to the flat shape. Clips of a tenter frame 75 then engage the paper tapes to exert a constant tension on the fill strands as the fill strands are fed into the nip of the pressure rolls as illustrated in FIG. 2.

In FIG. 2 the warp strands 16 are fed in on the top of the pressure roll 13 in the direction indicated by the block arrow 77, and the fabric 18 moves out and away from the pressure rolls in the direction indicated by the block arrow 79.

In the embodiment shown in FIG. 2 the transport belt 36 is preferably separated from the set of fill strands 15 before the fill strands are fed into the nip of the pressure rolls; however, the transport belt 36 with the release coating can be fed into the nip of the pressure rolls with the set of fill strands 15 and then released from the completed fabric 18 on the outlet side of the pressure rolls.

In the embodiment of the invention illustrated in FIG. 1, the fabric 18 is held in position between two release belts 81 ad 83 until the bonds between the fill strands and the warp strands have gained strength by cooling. The release belts 81 and 83 are trained over the rollers 14 and 13 and over a pair of transport rollers 85 and 87.

The fabric 18 is cooled by evaporative coolers 89 and 91, and refrigerated cooling may also be provided, if needed, by refrigerated coolers 95 and 97.

A coating roller 99 applies a silicone release coating to the lower belt 81, and a similar coating roller 101 applies a silicone coating to the upper belt 83.

Curing ovens 103 and 105 are associated with the belts 81 and 83 to cure the release coatings as applied by the rollers 99 and 101.

It has been found that when fill transfer fabrics are made of heavy, low twist yarn bundles, such as 20 end fiberglass roving, the adhesive from the fill strands 15 does not penetrate the band of warp strands 16 sufficiently to prevent filaments from hanging loosely from the side of the fabric opposite the fill strands.

To prevent the loose strands, the embodiment of the invention shown in FIG. 1 prints adhesive lines on the backside of the fabric 18 (the side not contacted by the set of fill strands 15). These adhesive lines are printed on the fabric at a spacing from ½ or fewer lines per inch up to adjacent and touching. The adhesive penetrates far enough into the bundle of warp strands to eliminate hanging warp strands.

Figure 7:
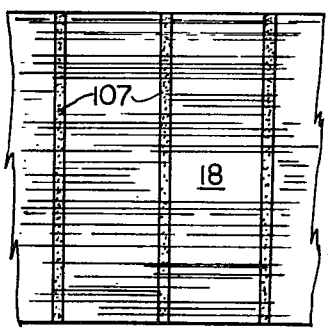
FIG. 7 is a bottom plan view of the fabric shown in FIG. 6.
Figure 6:
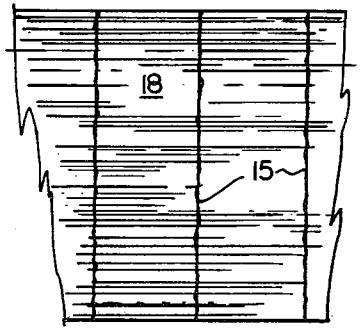
FIG. 6 is a fragmentary top plan view of one fabric constructed in accordance with the present invention.

In the embodiment illustrated in FIG. 1 a tray 107 contains adhesive, and a roller 109 prints lines of adhesive on the release belt 81. These lines of adhesive are then transferred from the release belt 81 to the bottom side of the warp strands 16 as this surface of the release belt is pressed into contact with the warp strands in the nip of the pressure rolls 13 and 14. The adhesive lines on the fabric are the lines 107 shown in FIG. 7.

In another embodiment of the invention the adhesive lines are printed directly on the bottom side of the warp strands rather than being transferred from a release belt. In certain cases this direct printing of the adhesive lines provides more penetration of the adhesive into the warp strand bundle.

The release belts 81 and 83, the set of fill strands 15, the adhesive lines 107 and all warp strands 16 continue through the coolers 89 and 91 at the same speed and in contact with one another until sufficiently cool to permit the release belts 81 and 83 to be separated without disturbing the fill strands or adhesive lines attached to the warp strands.

After the fabric 18 and release belts 81 and 83 are separated, the fabric 18 is wound up into a roll.

A typical scrim construction of the set of fill strands 15 used in the FIG. 1 embodiment has 1 to 4 warp strands per inch and ½ to 16 fill strands per inch. In one specific embodiment the warp strands are 75 1/0 fiberglass while the fill strands are 70 denier nylon.

Adhesive can be applied to the warp strands of the scrim 15, but for most constructions the fill strands contain 95% or more of the adhesive in the scrim.

A typical adhesive used for the fill strands is a thermoplastic polyester adhesive (in a solvent solution in the magazines). An oven on the machine 21 heats the adhesive to remove the solvent from the scrim.

Multilayer fabrics can also be made from the unidirectional fabrics made by the processes described above. The multilayer fabrics can be unidirectional, bidirectional or multidirectional.

One multilayer fabric construction involves feeding two unidirectional webs (previously made on the machine 21 shown in FIG. 3) into the nip of fill transfer machine 11 shown in FIG. 1 between the release belts 81 and 83 with the fill strands of the two unidirectional webs on the outside. At the same time a set of fill strands coated with adhesive is fed into the nip between the two fabrics. The multilayer fabric is then subjected to sufficient heat and pressure to cause all the layers to adhere together.

In another embodiment the two unidirectional webs have fill strands on one side and one or both have printed adhesive lines on the other side. In this embodiment there is no need to introduce additional fill strands between the two webs, since the printed glue lines cause the two webs to adhere to one another.

In other applications of the present invention one of the webs is cut at an angle and is fed into the nip with the fill strands away from the release belt while another fabric piece is fed into the pressure rolls with the fill strands of the additional piece against the first web. Each angled cut of fabric then abutts the previous piece so that a bidirectional fabric is produced.

Multidirectional fabrics are produced by laying other pieces cut at other angles on one or both sides of the unidirectional fabric as the pieces of fabric are fed into the nip of the pressure rolls 13 and 14.

The present invention provides methods and apparatus for making nonwoven fabrics in economical widths with warp strand materials that are difficult to handle. The invention enables the spacing, orientation and tensioning of all the strands of the fabric to be precisely maintained while introducing a minimum of foreign material into the product.

Because the adhesive is put on the fill strands first and then is softened by pressure and/or heat to adhere to the warp strands 16 in the machine shown in FIG. 1, the way in which the adhesive is caused to flow and penetrate in between the warp strands 16 helps to maintain the spacing that has been set up by the guide 17. Forcing the adhesive down in between these warp strands in this manner helps to maintain the spacing that has been set up. Forcing the adhesive down onto and between the warp strands 16 helps to prevent rolling and twisting of the warp strands, particularly in view of the fact that the heated adhesive provides viscous flow rather than being in a liquid state.

By using very few and widely spaced warp strands, or no warp strands at all, in the process of preparing the set of fill strands to be transferred, clean edges are produced. When the set of fill strands is cut and opened from the tubular configuration to the flat configuration there is no cutting back and forth across warp strands. This also eliminates wastage, which is an important consideration with some materials such as expensive graphite materials.

In many materials, particularly unidirectional materials such as bundles of fiberglass or tapes of graphite it is desirable to keep the introduction of foreign material to a minimum, since any foreign material can adversely affect the desired physical properties. The present invention, which minimizes the amount of adhesive and which confines the adhesive to relatively narrow width lines running across the direction of the warp strands provides advantages in minimizing both the amount and the effect of foreign material in such unidirectional fabrics.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. Apparatus for transferring fill strands to warp strands to form a fabric and comprising, a set of pressure rolls, warp guide means for guiding warp strands into the nip of the pressure rolls, fill strand feed means for feeding a pre-formed planar set of adhesive coated fill strands having fixed orientation and spacing into the nip of the pressure rolls, and wherein the adhesive on the fill strands is a composition which is heat activated under the pressure and/or heat produced in the pressure rolls to flow and to adhere to the warp strands to form the fabric.

2. The invention defined in claim 1 including release belt means trained about one of the pressure rolls and engageable with the side of the warp strands opposite that engagable by the fill strands, and adhesive printing means for printing lines of adhesive across the warp strand engaging surface of the release belt prior to engagement of the release belt with the warp strands in the nip of the pressure rolls so that adhesive is transferred from the adhesive lines on the release belt to the warp strands and is caused, by the pressure and/or heat produced in the nip of the pressure rolls, to penetrate the band of warp strands far enough to prevent warp strands from hanging loosely from the side of the fabric opposite the fill strands.

3. The invention defined in claim 2 including a second release belt trained about the other one of the pressure rolls and engageable with the side of the fabric having the fill strands, belt transport means for maintaining the first and second release belts engaged with the fabric for a substantial distance at the outlet of the pressure rolls, and cooling means associated with the first and second release belts for cooling the fabric and for increasing the bond strength of the adhesive prior to separation of the release belt from the fabric.

4. The invention defined in claim 1 including heating means for heating at least one of the pressure rolls.

* * * * *